US010196843B2

(12) United States Patent
Hickman

(10) Patent No.: US 10,196,843 B2
(45) Date of Patent: Feb. 5, 2019

(54) ANTI-FRICTION LATCHBOLT

(71) Applicant: STANLEY SECURITY SOLUTIONS, INC., Indianapolis, IN (US)

(72) Inventor: Chad A. Hickman, Rensselaer, IN (US)

(73) Assignee: dormakaba USA Inc., Indianapolis, IN (US)

( * ) Notice: Subject to any disclaimer, the term of this patent is extended or adjusted under 35 U.S.C. 154(b) by 0 days.

(21) Appl. No.: 14/433,161

(22) PCT Filed: Oct. 4, 2013

(86) PCT No.: PCT/US2013/063407
§ 371 (c)(1),
(2) Date: Apr. 2, 2015

(87) PCT Pub. No.: WO2014/055839
PCT Pub. Date: Apr. 10, 2014

(65) Prior Publication Data

US 2015/0259955 A1 Sep. 17, 2015

Related U.S. Application Data

(60) Provisional application No. 61/710,261, filed on Oct. 5, 2012.

(51) Int. Cl.
*E05C 1/02* (2006.01)
*E05C 1/08* (2006.01)
(Continued)

(52) U.S. Cl.
CPC ..... *E05C 1/02* (2013.01); *E05B 15/102* (2013.01); *E05B 17/007* (2013.01); *E05C 1/085* (2013.01); *Y10T 292/096* (2015.04)

(58) Field of Classification Search
CPC ..... Y10T 70/5226; Y10T 292/564; Y10T 292/1037; Y10T 292/558; Y10T 292/0803;
(Continued)

(56) References Cited

U.S. PATENT DOCUMENTS 1,988,251 A * 1/1935 Pattison ..... A63F 7/0608 273/108.3
2,482,959 A * 9/1949 Anderson ..... E05B 65/005 292/337
(Continued)

FOREIGN PATENT DOCUMENTS

CN 1697911 A 11/2005
DE 202010001358 6/2011
(Continued)

OTHER PUBLICATIONS

Office Action with translation dated Jun. 5, 2017, issued in corresponding Japanese Patent Application No. 2015-535815, 5 pages.
(Continued)

*Primary Examiner* — Mark A Williams
(74) *Attorney, Agent, or Firm* — Faegre Baker Daniels LLP

(57) ABSTRACT

A latchbolt assembly includes a solid latchbolt having at least a first surface, a second surface and a third surface and an anti-friction bolt pivotally coupled to the solid latchbolt. The anti-friction bolt includes a cross member disposed adjacent the first surface of the solid latchbolt and a pair of plates depending from the cross member to form a U-shaped cross section. The plates are disposed adjacent the second and third surfaces of the solid latchbolt.

21 Claims, 4 Drawing Sheets

(51) Int. Cl.
*E05B 15/10* (2006.01)
*E05B 17/00* (2006.01)

(58) Field of Classification Search
CPC ..... Y10T 292/0886; E05B 63/044; E05B 15/102; E05B 17/007; E05B 47/0607; E05B 63/14
USPC ..... 292/137
See application file for complete search history.

(56) References Cited

U.S. PATENT DOCUMENTS 2,515,560 A 7/1950 Lickteig
2,887,336 A * 5/1959 Meyer ..... E05B 63/20 292/21
3,172,691 A 3/1965 Russell
3,235,298 A * 2/1966 Check ..... E05B 59/00 292/5
3,257,135 A * 6/1966 Russell ..... E05B 59/00 292/192
3,359,027 A * 12/1967 Schlage ..... E05B 59/00 292/192
3,586,361 A * 6/1971 Ohno ..... E05C 19/163 292/153
3,600,022 A * 8/1971 Armstrong ..... E05B 63/20 292/237
5,009,089 A * 4/1991 Lin ..... E05B 63/126 292/49
7,775,565 B2 * 8/2010 Hartmann ..... A47L 15/4259 292/216
8,152,207 B2 * 4/2012 Hartmann ..... A47L 15/4259 292/335
9,151,093 B2 * 10/2015 Lin ..... E05C 1/08
2008/0246288 A1 * 10/2008 Hodgin ..... E05B 63/044 292/244

FOREIGN PATENT DOCUMENTS

EP 1162334 12/2001
JP S58-205468 2/1983
WO WO 2004076786 A1 9/2004

OTHER PUBLICATIONS

Office Action with translation dated Feb. 1, 2018, issued in corresponding Chinese Patent Application No. 201380052340.2, 11 pages.
Office Action with translation dated Oct. 30, 2015, issued in corresponding Chinese Patent Application No. 201380052340.2, 10 pages.
Office Action with translation dated Jul. 28, 2016, issued in corresponding Chinese Patent Application No. 201380052340.2, 10 pages.
Office Action with translation dated Mar. 8, 2017, issued in corresponding Chinese Patent Application No. 201380052340.2, 13 pages.
European Search Report dated Aug. 26, 2016.
People's Republic of China Search Report dated Jul. 28, 2016.
Office Action with English translation date Jul. 11, 2018, issued in corresponding Chinese Patent Application No. 201380052340.2, 16 pages.

* cited by examiner

ANTI-FRICTION LATCHBOLT

The present invention relates to latchbolts in general and anti-friction latchbolts in particular.

BACKGROUND OF THE INVENTION

Various means have been used to reduce friction on latches. One reason for this effort is to minimize wear on the latch. Another reason is to minimize the likelihood that a door will not fully close, thereby leaving a room susceptible to unauthorized access.

Past efforts illustrated in FIG. 1 typically include a latchbolt having a first portion 10 with two fingers 12 extending longitudinally from a base portion 14 forming a yoke and a second portion 16 pivotally mounted between the two fingers 12. Such latchbolts are typically installed in mortise boxes having a front plate through which the latchbolt extends to engage a strike installed in the doorjamb.

The second portion 16 includes a shoulder 18 extending therefrom in the direction of the closing action of the door. As the door closes, the second portion 16 engages the strike and is thereby pivoted between the two fingers 12. As the second portion 16 pivots, the shoulder 18 engages the inner surface of the front plate, thereby beginning the retraction of the latchbolt into the mortise box before the two fingers 12 engage the strike.

Past efforts have proven to be weak and lacking in durability. The present invention overcomes these disadvantages by providing an outside anti-friction bolt that is stronger and more durable than conventional anti-friction bolts.

SUMMARY OF THE INVENTION

A latchbolt assembly includes a solid latchbolt having at least a first surface, a second surface and a third surface and an anti-friction bolt pivotally coupled to the solid latchbolt. The anti-friction bolt includes a cross member disposed adjacent the first surface of the solid latchbolt and a pair of plates depending from the cross member. The plates are disposed adjacent the second and third surfaces of the solid latchbolt. In preferred embodiments, the latchbolt includes a curved camming surface and the cross member is configured to cooperate with the curved camming surface to assist retraction of the latchbolt into a mortise box. In other embodiments, the anti-friction bolt has a U-shaped cross section, wherein the anti-friction bolt is pivotally coupled to the solid latchbolt.

In still other embodiments, a latchbolt assembly includes a rod, a solid latchbolt coupled to the rod, and an anti-friction bolt pivotally coupled to the solid latchbolt. The anti-friction bolt includes a cross member and a pair of plates depending orthogonally from the cross member, with the cross member and plates cooperating to form a U-shaped cross-section. The anti friction bolt is disposed to straddle the solid latchbolt on three sides.

DETAILED DESCRIPTION OF THE DRAWINGS

Figure 10:
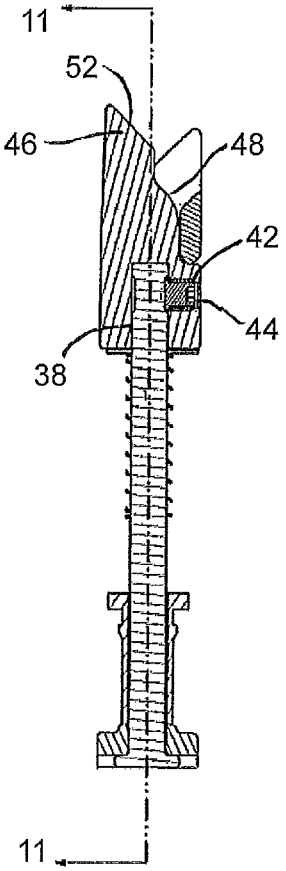
FIG. 10 is a section view taken along lines 10-10 of FIG. 11.
Figure 11:
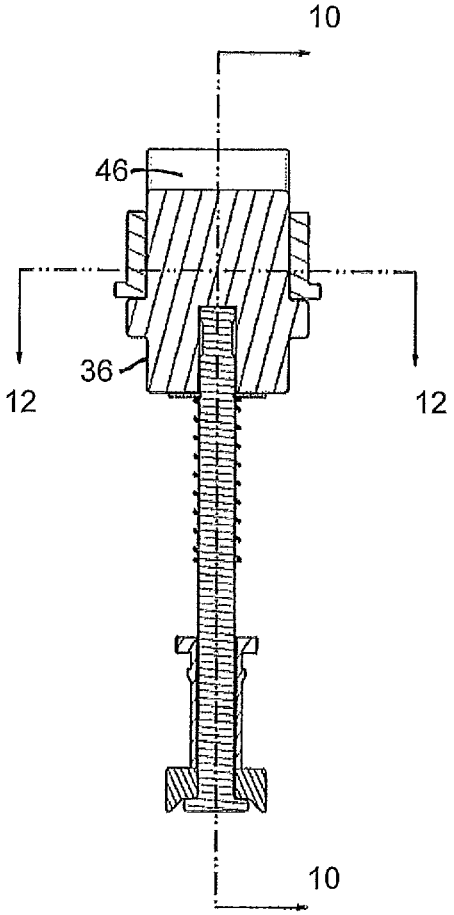
FIG. 11 is a section view taken along lines 11-11 of FIG. 10.

An exemplary latchbolt assembly 20 is shown in FIGS. 2 and 10-12. The latchbolt assembly 20 includes a tailpiece 22, a rod 24, a bushing 26, a spring 28, a solid one piece latchbolt 32, and an anti-friction bolt 34. The tailpiece 22, rod 24, bushing 26 and spring 28 are assembled into a rod assembly 30 and coupled to the solid one piece latchbolt 32 as illustrated in FIGS. 10-11.

Figure 1:
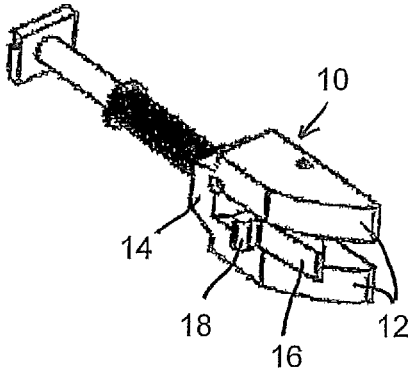
Figure 1 PRIOR ART
FIG. 1 illustrates a prior art latchbolt.
Figure 2:
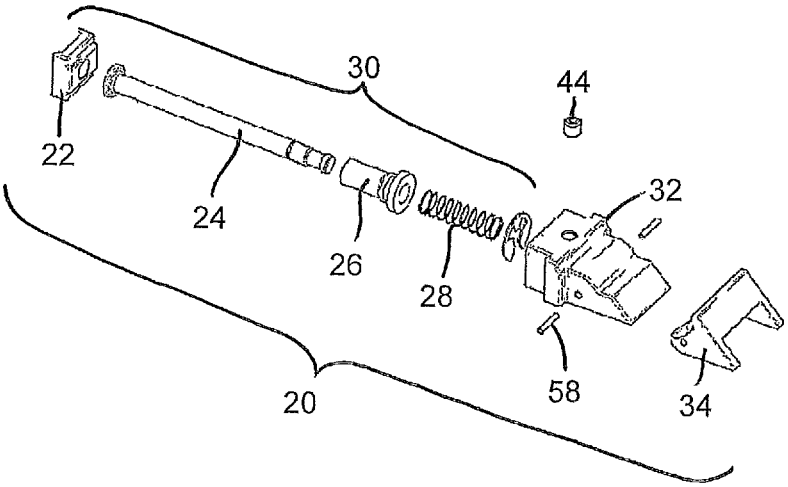
FIG. 2 is an exploded view of an exemplary latchbolt according to the present invention.
Figure 3:
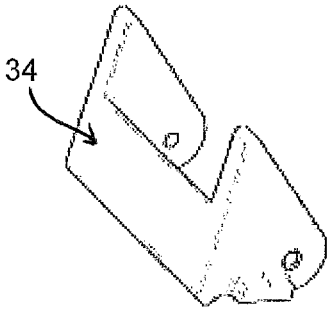
FIGS. 3-9 are views of an exemplary anti-friction bolt for use with the latchbolt of FIG. 2.
Figure 4:
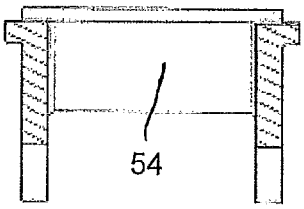
Figure 5:
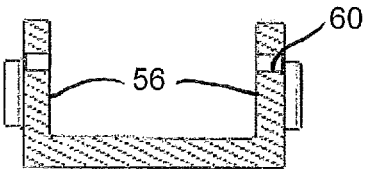
Figure 6:
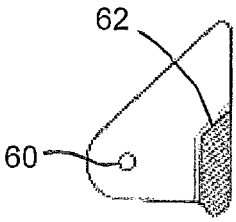
Figure 7:
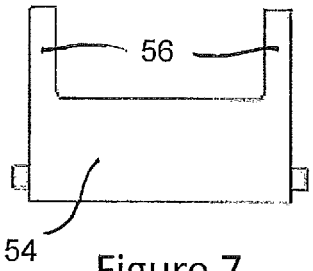
Figure 8:
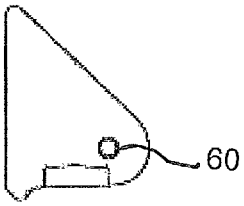
Figure 9:
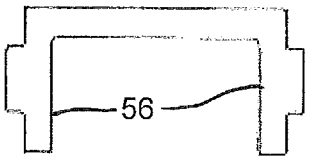
Figure 12:
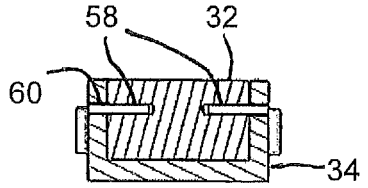
FIG. 12 is a section view taken along lines 12-12 of FIG. 11.

The anti-friction bolt 34 as illustrated in FIGS. 3-9 has a generally U-shaped cross section. It includes a cross member 54 and a pair of plates 56 depending orthogonally therefrom. The plates 56 include pivot pin apertures 60 for receiving pivot pins 58 as illustrated in FIG. 12. The cross member 54 includes a beveled edge 62

The solid one piece latchbolt 32 includes a base portion 36 having a rod assembly-receiving bore 38 and a retaining screw bore 42. The rod assembly 30 is operatively disposed in the rod assembly-receiving bore 38 and a retaining screw 44 is operatively disposed in the retaining screw bore 42 to engage the rod assembly 30, thereby retaining the rod assembly 30 in the base portion 36. The solid one piece latchbolt 32 further includes a strike-engaging portion 46 that includes a curved camming surface 48 and a beveled camming surface 52.

The orthogonal plates 56 of the anti-friction bolt 34 extend parallel to and adjacent to the solid one piece latchbolt 32 as illustrated in FIGS. 11-12. The plates 56 are pivotally coupled to the solid one piece latchbolt 32 by pivot pins 58. 'Thus, the anti-friction bolt 34 is configured to straddle the solid latchbolt 32 on three sides as illustrated in FIG. 12. When pivotally coupled to the solid latchbolt 32, the cross member 54 is configured to engage the curved camming surface 48 of the solid one piece latchbolt 32.

Figure 13:
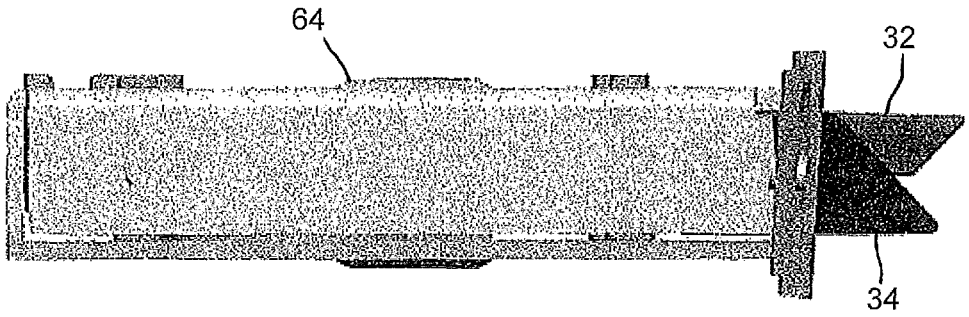
FIG. 13 is a top view of a mortise box with the exemplary latchbolt of FIG. 2 disposed therein with the latchbolt in the fully extended configuration.
Figure 14:
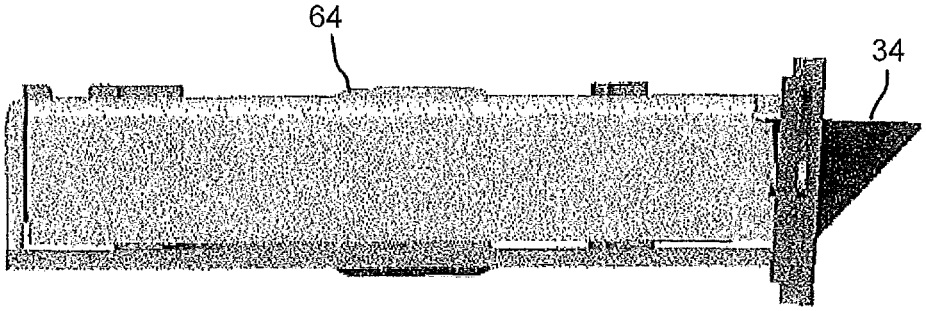
FIG. 14 is a top view of a mortise box with the exemplary latchbolt of FIG. 2 disposed therein with the latchbolt in the partially retracted configuration.

In operation, the latchbolt assembly 20 is conventionally installed in a mortise box 64 as illustrated in FIGS. 13-14. The mortise box 64 is installed in a door edge and positioned to align the latchbolt assembly 20 with a strike formed in a doorjamb in a known manner. As the door is closed, the strike engages the leading edges of the orthogonal plates 56, causing the anti-friction bolt 34 to pivot about the pivot pins 58. As the anti-friction bolt 34 pivots, the cross member 54 of anti-friction bolt 34 engages the curved camming surface 48 of the solid latchbolt 32, cooperating with the strike and the pivot pins 58 to partially force the latchbolt assembly 20 into the mortise box 64. The anti-friction bolt 34 continues to pivot about the pivot pins 58 until the leading edges of the orthogonal plates 56 align with the beveled camming surface 52 of the solid latchbolt 32. Once the leading edges and solid latchbolt 32 are aligned, the strike cams against the solid latchbolt 32 and the anti-friction bolt 34 to continue retracting the latchbolt assembly 20 into the mortise box 64.

While a number of exemplary aspects have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A latchbolt assembly comprising:

a solid latchbolt having at least a first exterior surface, a second exterior surface opposite the first exterior surface and non-intersecting with the first exterior surface, and a third exterior surface located between the first exterior surface and the second exterior surface; and an anti-friction bolt carried by and pivotally coupled to the solid latchbolt, the anti-friction bolt including a first side member overlapping a portion of the first exterior surface of the solid latchbolt, a second side member overlapping a portion of the second exterior surface of the solid latchbolt, and a cross member extending from the first side member towards the second side member, the cross member overlapping at least a portion of the third exterior surface of the solid latchbolt, the anti-friction bolt configured to assist in retraction of the solid latchbolt wherein when the anti-friction bolt pivots relative to the solid latchbolt in a first direction, the cross-member engages and forces the solid latchbolt to at least partially retract along a length of the latchbolt assembly.

2. A latchbolt assembly comprising:

a rod;

a solid latchbolt coupled to the rod, the solid latchbolt having a strike engaging portion; and an anti-friction bolt having a U-shaped cross section having a portion positioned adjacent the strike engaging portion of the solid latchbolt, the anti-friction bolt being pivotally coupled to the solid latchbolt and configured to assist in retraction of the solid latchbolt, wherein when the anti-friction bolt pivots relative to the solid latchbolt in a first direction, the portion positioned adjacent the strike engaging portion of the solid latchbolt engages and forces the solid latchbolt to at least partially retract along a length of the rod.

3. The latchbolt assembly of claim 2 wherein the portion of the anti-friction bolt positioned adjacent the strike engaging portion of the solid latchbolt includes a cross member disposed across the solid latchbolt, the cross member being configured to engage the solid latchbolt.

4. The latchbolt assembly of claim 2, wherein the anti-friction bolt is pivotably coupled to the solid latchbolt and the solid latchbolt is fixedly coupled to the rod.

5. The latchbolt assembly of claim 2, wherein the anti-friction bolt is pivotably coupled to the solid latchbolt and is carried by the solid latchbolt.

6. The latchbolt assembly of claim 2, wherein the rod and the solid latchbolt axially retract together.

7. The latchbolt assembly of claim 1, wherein the solid latchbolt includes a curved camming surface and the cross member is configured to cooperate with the curved camming surface to assist retraction of the latchbolt into a mortise box.

8. The latchbolt assembly of claim 1, wherein the anti-friction bolt is directly pivotably coupled to the solid latchbolt.

9. A latchbolt assembly comprising:

a rod;

a solid latchbolt coupled to the rod including a strike engaging portion; and an anti-friction bolt carried by and pivotally coupled to the solid latchbolt, the anti-friction bolt including a cross member and a pair of plates depending orthogonally from the cross member, the cross member and plates cooperating to form a U-shaped cross-section, the anti-friction bolt being disposed to overlap the solid latchbolt on a plurality of exterior sides of the solid latchbolt, the anti-friction bolt configured to assist in retraction of the solid latchbolt wherein when the anti-friction bolt pivots relative to the solid latchbolt in a first direction, the cross-member engages and forces the solid latchbolt to at least partially retract along a length of the rod.

10. The latchbolt assembly of claim 9, wherein the solid latchbolt includes a strike engaging portion having a beveled camming surface and the cross member overlaps a portion of the beveled camming surface.

11. The latchbolt assembly of claim 9, wherein the anti-friction bolt is pivotably coupled to the solid latchbolt and the solid latchbolt is fixedly coupled to the rod.

12. A method of reducing friction on latches, the method comprising:

positioning a latchbolt within an interior of a mortise box, the latchbolt having a strike engaging portion with a camming surface being extendable from the mortise box; and coupling an anti-friction bolt to the latchbolt such that the anti-friction bolt is rotatable relative to the latchbolt to position a portion of the anti-friction bolt in an overlapping relationship relative to the camming surface of the latchbolt and such that the anti-friction bolt is translatable relative to the mortise box along with the latchbolt, wherein the anti-friction bolt is configured to assist in retraction of the latchbolt, wherein when the anti-friction bolt pivots relative to the latchbolt in a first direction, the anti-friction bolt engages the camming surface and forces the latchbolt to at least partially retract with the mortise box.

13. A latchbolt assembly comprising:

a rod;

a latchbolt including a strike engaging end having an exterior camming surface and a base end positioned opposite the strike engaging end, the latchbolt further having a first side extending between the strike engaging end and the base end and a second side extending between the strike engaging end and the base end, the second side being opposite the first side, the latchbolt being coupled to the rod; and an anti-friction bolt moveable relative to the latchbolt, the anti-friction bolt being positionable adjacent the exterior camming surface of the strike engaging end of the latchbolt to overlap the exterior camming surface of the strike engaging end of the latchbolt and configured to assist in retraction of the latchbolt, wherein when the anti-friction bolt pivots relative to the latchbolt in a first direction, the anti-friction bolt engages the exterior camming surface and forces the latchbolt to at least partially retract along a length of the latchbolt assembly.

14. The latchbolt assembly of claim 13, wherein the exterior camming surface of the latchbolt intersects a longitudinal axis of the rod.

15. The latchbolt assembly of claim 13, wherein the exterior camming surface of the latchbolt is a beveled camming surface.

16. The latchbolt assembly of claim 13, further comprising a tailpiece having an open interior, the rod being received in the open interior of the tailpiece;

a bushing carried by the rod and positioned between the latchbolt and the tailpiece; and a spring carried by the rod and positioned between the latchbolt and the bushing.

17. The latchbolt assembly of claim 13, further comprising a retaining screw coupling the rod to the latchbolt, the retaining device being received in a first opening of the latchbolt having a first longitudinal axis and the rod being received in a second opening of the latchbolt having a second longitudinal axis, the first longitudinal axis of the first opening being non-parallel to the second longitudinal axis of the second opening.

18. The latchbolt assembly of claim 13, wherein the latchbolt is a solid latchbolt.

19. The latchbolt assembly of claim 13, wherein the anti-friction bolt is pivotable relative to the latchbolt.

20. The latchbolt assembly of claim 13, wherein the anti-friction bolt includes a first leg overlapping a portion of the first side of the latchbolt, a second leg overlapping a portion of the second side of the latchbolt, and a cross member extending between the first leg and the second leg, the cross member overlapping a portion of the exterior camming surface.

21. The latchbolt assembly of claim 13, further comprising a tailpiece having an open interior, the rod being received in the open interior of the tailpiece;

a bushing carried by the rod and positioned between the latchbolt and the tailpiece; and a spring carried by the rod and positioned between the latchbolt and the bushing, wherein the exterior camming surface of the latchbolt intersects a longitudinal axis of the rod and the anti-friction bolt is pivotable relative to the latchbolt.

* * * * *